United States Patent [19]

Sun

[11] Patent Number: 4,796,407

[45] Date of Patent: Jan. 10, 1989

[54] METHOD AND FITTINGS ENABLING ARTICLES TO BE RAPIDLY TAKEN INTO AND OUT OF A CASE

[76] Inventor: Ko-Lin Sun, No. 4, Song Bor Lane, Fu Shing Road, Li Shan Tsuen, Tai Chung Shian, Taiwan

[21] Appl. No.: 79,517

[22] Filed: Jul. 30, 1987

[51] Int. Cl.[4] ..... B65B 35/30; B65B 5/06; B65B 67/02

[52] U.S. Cl. ..... 53/390; 53/473; 53/536; 53/241

[58] Field of Search ..... 53/390, 536, 473, 475, 53/535, 492, 245, 241

[56] References Cited

U.S. PATENT DOCUMENTS

| | | | |
|---|---|---|---|
| 1,434,587 | 11/1922 | Broadley | 53/536 X |
| 2,830,416 | 4/1958 | Edwards et al. | 53/536 |
| 2,921,702 | 1/1960 | Gross | 53/536 X |
| 4,104,846 | 8/1978 | Waller | 53/536 X |
| 4,640,079 | 2/1987 | Stuck | 53/390 |

FOREIGN PATENT DOCUMENTS

| | | | |
|---|---|---|---|
| 1314057 | 4/1973 | United Kingdom | 53/536 |
| 2009702 | 6/1979 | United Kingdom | 53/536 |

*Primary Examiner*—James F. Coan
*Attorney, Agent, or Firm*—Bacon & Thomas

[57] ABSTRACT

A method and apparatus are disclosed enabling articles to be rapidly packed into and unpacked from a case. The apparatus has a floating top such that the contents of the case will remain motionless, while the case is lowered or raised by a lifting device so as to achieve the object of rapidly taking the contents into and out of a case. Rod holes are formed on the bottom of the case which are similar in shape and alignment with the cylindrical rods on the lifting device. The lifting device has portable housing, five cylindrical rods of the same diameter, guiding sleeve, a slide plate, a cross-member and other fittings. The five cylindrical rods of the same diameter are inserted into central rod-receiving openings located on the housing to guide the slide plate. The lifting or lowering of the slide plate is controlled by a mechanism located on the housing.

14 Claims, 5 Drawing Sheets

METHOD AND FITTINGS ENABLING ARTICLES TO BE RAPIDLY TAKEN INTO AND OUT OF A CASE

BACKGROUND OF THE INVENTION

Since a hole in support of the top of a case is not available on the bottom of a conventional case, the operational method for packing or unpacking articles is usually carried out by taking one article or one layer of articles at a time. This method not only wastes time and energy, but also may damage the articles which are being packed, especially those articles packed or unpacked one layer as one unit. Although this method saves more time than packing or unpacking the case piece by piece, it necessarily adopts a slanting method of packing for an economical, time saving and smooth packing of articles. This method, however, may cause the falling down of the articles packed in a layer against other articles which have not yet been packed, and thus increase the rate of defects. Moreover, in consideration of the abrasion caused during the transportation and other factors, the packing of articles fully into the space of the interior of the case body is regarded as the highest objective of packing, under which one has to stretch one's hand into the case in order to take out the contents. This will not ony waste a lot of time and reduce working efficiency, but sometimes will also bring injury to the arm.

Taking a fruit case as an example, it is commonly understood that fruit is packed in layers, which not only allows a much bigger space for the fruit to be packed into the case, but will also maintain the quality of the fruit which is packed into the case. Under this method of packing, the fruit is packed layer after layer into the case in a slanting manner (saving more time than packing piece by piece). Sometimes the fruit thus packed will accidentally fall down and bring injury to the packers arm. When the quality of the packed fruit is to be checked, the fruit must be taken out layer by layer from the case, thus causing a lot of time and trouble.

SUMMARY OF THE INVENTION

The packing and unpacking of fruit and other objects such as antiques, wine and spirits, books, or other easily broken articles can be carried out by this invention so as to achieve the object of safely and rapidly accomplishing the packing of articles into and the unpacking of articles from a case.

The principal object of this invention is to provide a safe and rapid method and apparatus for the packing of articles into the unpacking articles from a case.

Another object of this invention is to provide an assembly-type of lifting device which is portable and can be easily assembled and disassembled.

In order to facilitate the further understanding of this invention, a detailed description in coordination with drawings enclosed herewith is made as follows:

DETAILED DESCRIPTION OF THE PREFERRED EMBODIMENTS

Figure 1:
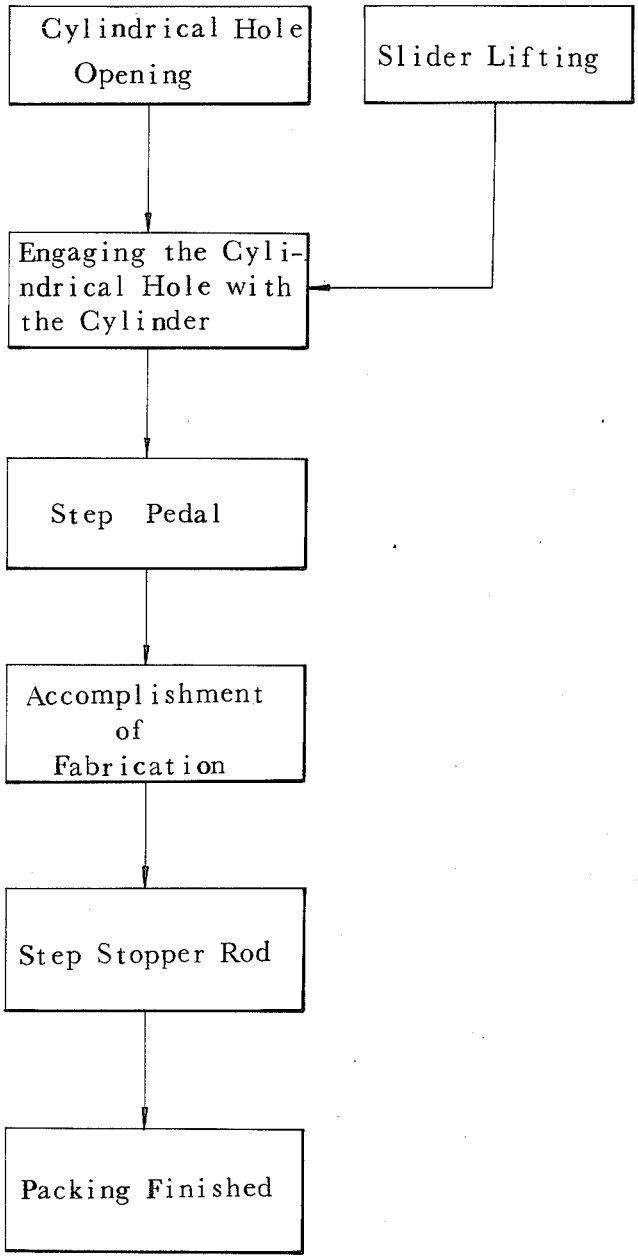
FIG. 1 is a flow chart illustrating the operational procedures of this invention.

FIG. 1 indicates that the operation of this invention is indeed very simple, wherein the first step is to drill round holes in the bottom of the case under fabrication. Also, at the same time, the slide of the lifting device is lifted and fixed at a position parallel to the top end of the rods. The second step is to place the case over the slide so that its round holes will be in alignment with the rods. The third step is to step on the pedal of the stopper mechanism such that the case body will fall down with the slide. The fourth step is that under which the articles contained therein will remain motionless on the rods, so as to achieve the rapid unpacking of the articles from the case. The fifth step is to step on the stopper until it is locked up by the "U" shaped rod located on the stopper mechanism.

Figure 2:
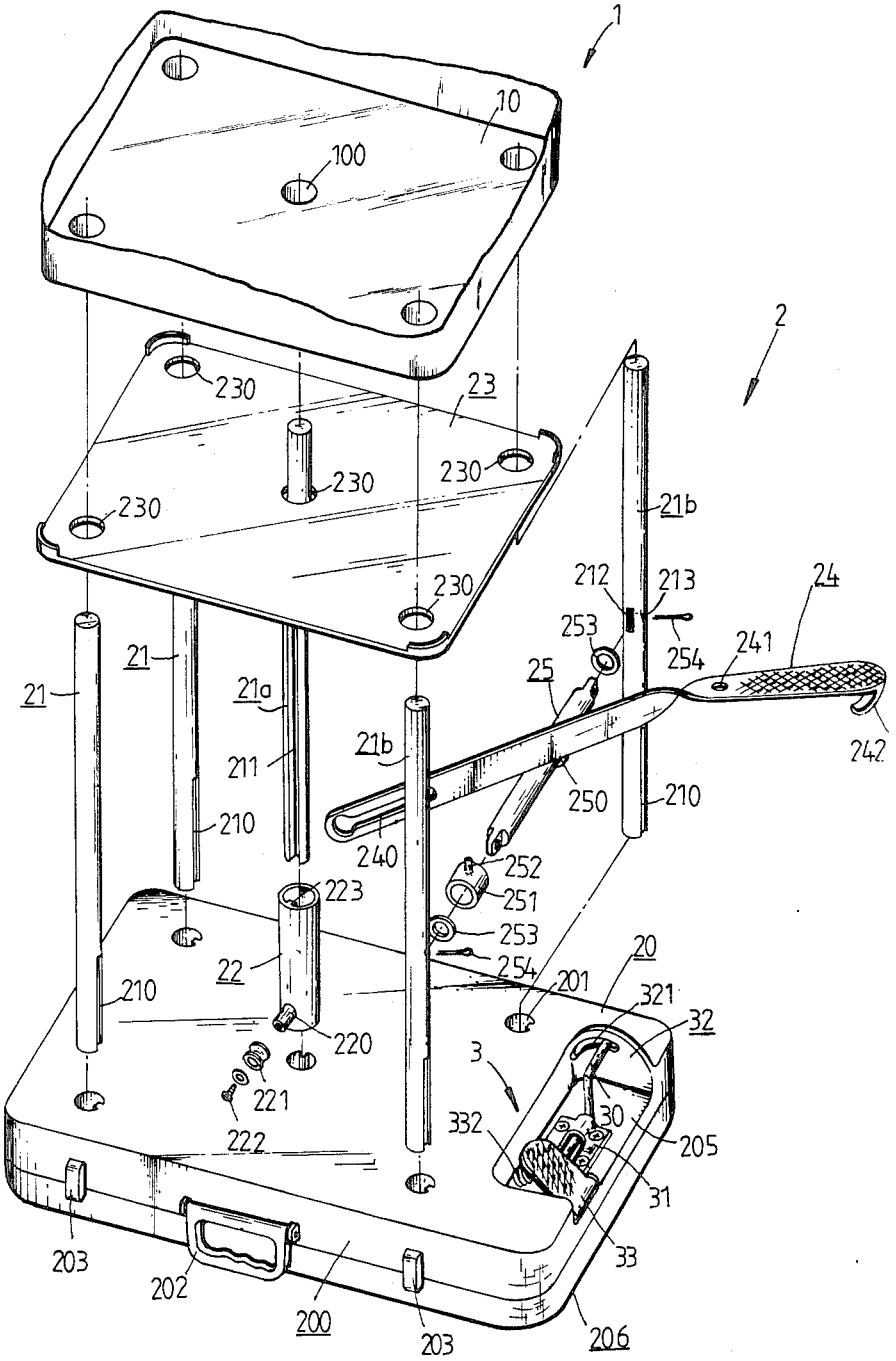
FIG. 2 is an exploded, perspective view of the system of this invention.

As illustrated in FIG. 2, this invention comprises a case 1 having round holes 100 formed in its bottom 10 and a lifting device 2. The lifting device 2 is composed of a portable housing 20, five cylindrical rods 21, **21*a* and 21*b* of the same diameter, a guiding sleeve 22, a slide plate 23, a stopper arm 24 and a cross-member 25. The portable housing 20 is formed by linking the upper and lower body shell together. Holes 201 are formed on upper shell 200 which has handle 202 fixed at its front edge, with a locking device 203 fitted at a suitable distance at each of the two sides of the handle 202. A groove 204 is formed at the joining face where the upper and lower shells are connected together. Upper shell 200 has concave portion 205 formed in its right edge portion and a stopper mechanism 3 is fitted in the concave portion 205**.

Figure 3:
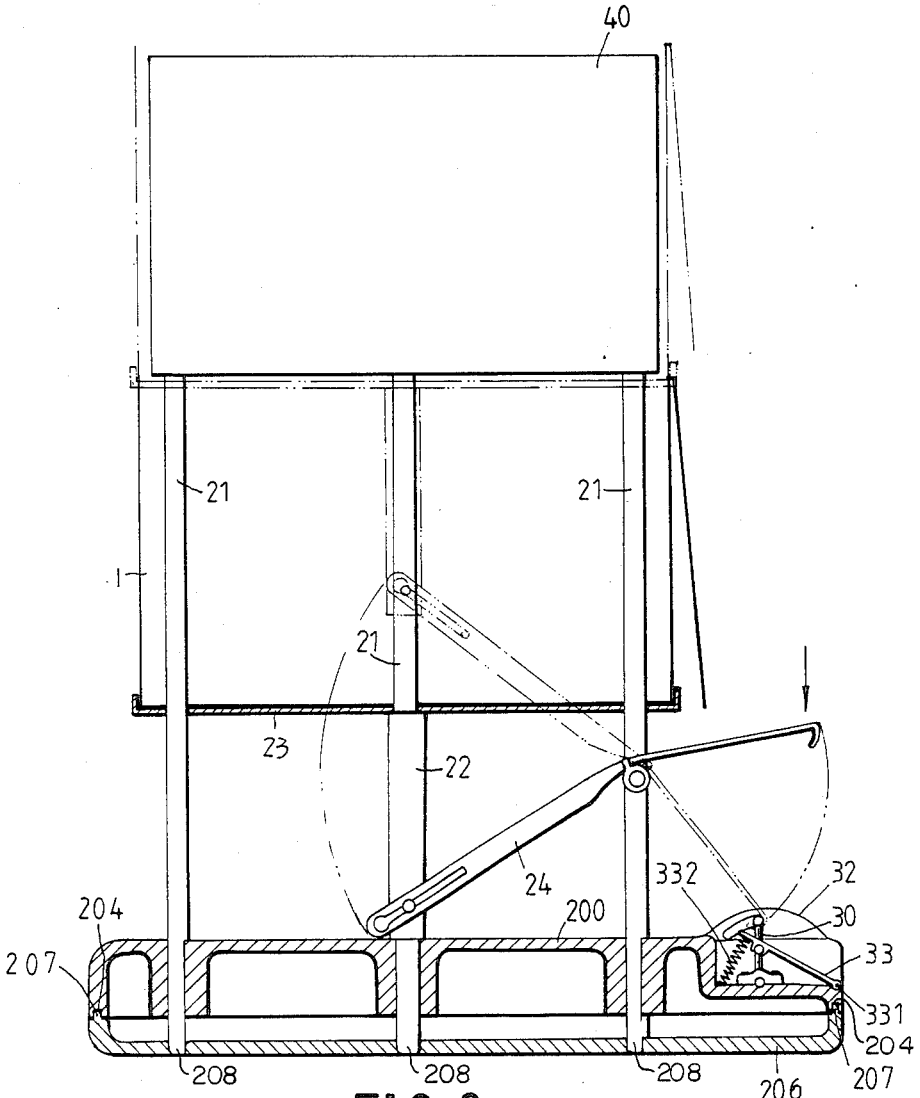
FIG. 3 is a side view of a first embodiment of this invention.

The said stopper mechanism 3 is securely fixed on the concave portion 205 by mounting a "U" shaped rod 30 by a fixed plate 31 on its central part so as to enable one end of the said "U" shaped rod 30 to extend through guiding groove 321 located on wall 32. The other end of rod 3a is attached to a pedal 33 which pivots about pin 331. The other edge of pedal 33 bears against compressor spring 332. The pedal 33 will be lifted by means of the force of compression spring 332 which will also lift the "U" shaped rod 30 upward as illustrated in FIG. 3. A ridge 207 is located on the joining face where the lower shell 206 and the upper shell 200 are joined together. Holes 208 similar in size and shape to holes 201, are formed in lower shell 206 in alignment with holes 201. Hooking pins 209 are set at the edge of lower shell 206 to facilitate the locking of the locking device 203 located on the upper shell 200, so that the upper and lower shell bodies can be integrally joined into a single housing 20. On each of the five cylindrical rods of the same diameter 21, **21*a* and 21*b*, a groove 210 is formed so as to coordinate with the protruding ridges in holes 201. Another groove 211 is formed on the cylindrical rod 21*a* to be inserted into the central hole. Insert openings 212 and an inserted pin hole 213 are formed in the two cylinders 21*b* which are inserted at the right side. Protrusion 220 extends from the lower edge of the guiding sleeve 22 to which a slide wheel 221 attached by is 222. Ridge 223 extends inwardly inside the guiding sleeve 22 to engage the guiding groove 211 of cylinder 21***a*. Slide plate 23 is of generally rectangular shape and defines five round holes 230 to match with the five cylindrical rods 21, 21*a* and 21*b* of the same diameter so that the five holes 230 can serve as openings for the receiving of the five cylindrical rods of the same diameter 21 when the slide plate 23 is lifted upward.

The stopper arm 24 is a plain strip twisted in such a way that it is formed into intersecting vertical and horizontal portions having a slot 240 set at the front edge of the vertical portion; a branch hole 241 set at the horizontal portion; and a locking hook 242 formed at its extreme end. Cross-member 25 is formed to have planar ends with openings therein to accommodate pins 254. A stopper block 250 is set at a position slightly past half of its length, to position mounting tube 251. On mounting tube 251, a pivot pin 252 is provided so that it can be inserted into the branch hole 241 on the stopper plate 24 and form a supporting point.

At the time of operation, the elements must be taken out of housing 20. The upper and lower shells 200 and 206 are locked together to form an integral housing 20. The guide sleeve 22 is placed on cylindrical rod 21*a* and the assembly is inserted into the hole 201 located at the central part of the housing 20. The cross-member 25 is engaged with the mounting tube 251 and its two sets of washers 253, and then inserted into holes 212 on the cylinders 21*b* and retained by inserting pins 254. Cylinders 216 are then inserted together into the holes 201 on housing 20. Slide plate 23 is place onto the five cylinders 21, 21*a* and 21*b*, and the branch hole 241 of stopper arm 24 is placed onto the pivot pin 252 of mounting tube 251 on cross-member 25. At the same time, slide wheel 221 engages the sliding hole 240 so that when stopper arm 24 performs an upward and downward motion by using branch cylinder 252 as a supporting, pivot point, slide wheel 221 will move along the sliding hole, and at the same time will achieve the objective of lifting slide plate 23 and thus accomplish the assembling. As for the mode of operation of this invention, please refer to the following description with reference to FIG. 3.

FIG. 3 illustrates the first example of this invention, wherein articles 40 are to be unpacked from the case 1. The case 1 is placed on the slide plate 23 of the lifting device 2 and arranged in such a way that the round holes 100 on the bottom 10 of the case 1 will engage cylindrical rods 21, 21*a* and 21*b*. When the stopper arm 24 is disengaged from the "U" shaped rod 30, slide plate 23 and case 1 will be lowered, leaving only articles 40 supported on the cylindrical rods 21, 21*a* and 21*b*, and thus achieve the object of rapidly taking the articles out of the case. In the event of packing articles 40 into the case, a step on the stopper arm 24 to move it as indicated by the arrow will cause slide plate 23 to push case 1 upward until hook 242 is in engagement with the "U" shaped rod 30.

Figure 4:
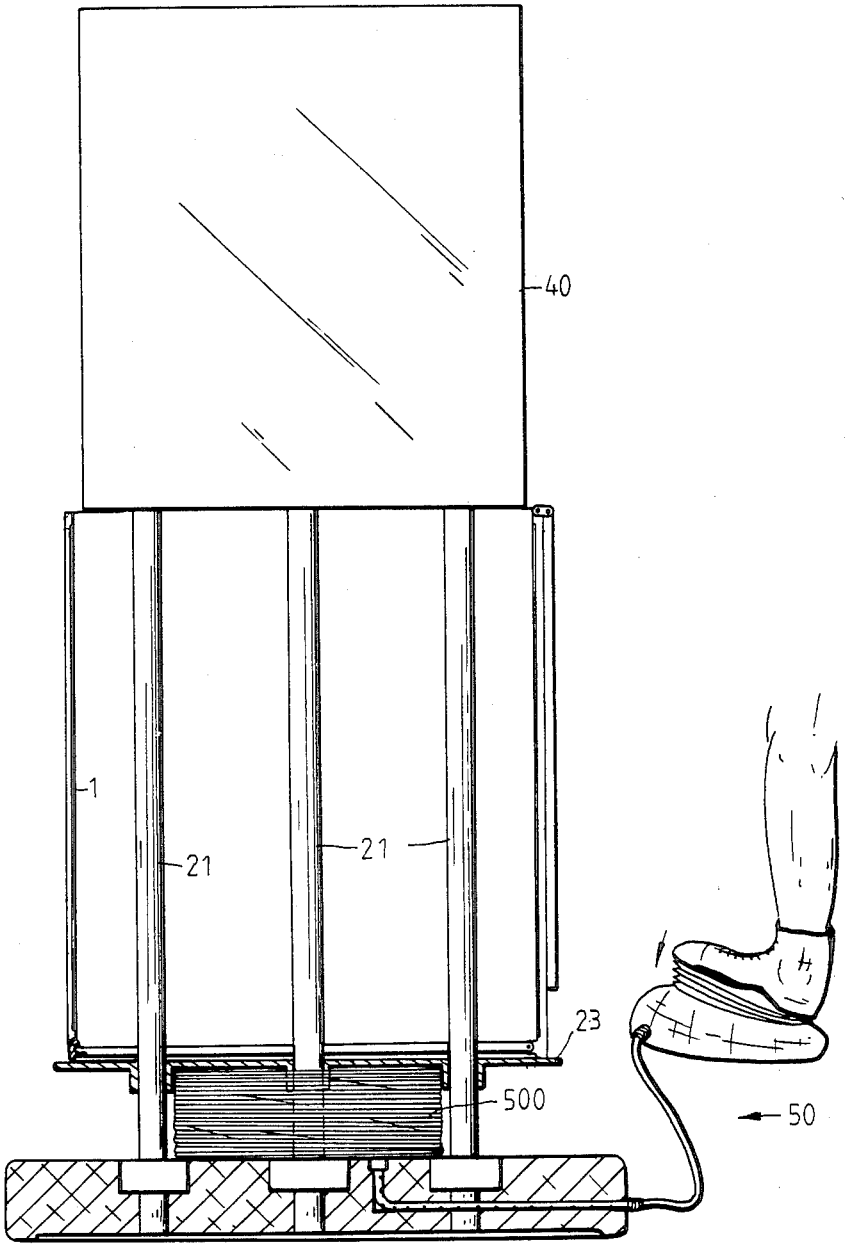
FIG. 4 is a side view of a second embodiment of this invention.

A different lifting device can also be applied to the method of this invention for a joint operation as shown by FIG. 4. Case 1 is similarly placed on the floating top device 50 with round holes 100 preset on the bottom 10 of the case in alignment with the cylindrical rods 21, such that the articles inside case 1 are placed on top of the cylindrical rods 21 and supported by the cylindrical rods 21. The case is gradually lowered under the assistance given by the operator and thus accomplish the object of rapidly unpacking the articles. After checking, the compressive gas container will allow the gas to enter into fill the case 1 will be lifted slowly upward under the slight support of the operator until the articles are entirely packed into case 1 and thus accomplish the operation of packing.

Figure 5:
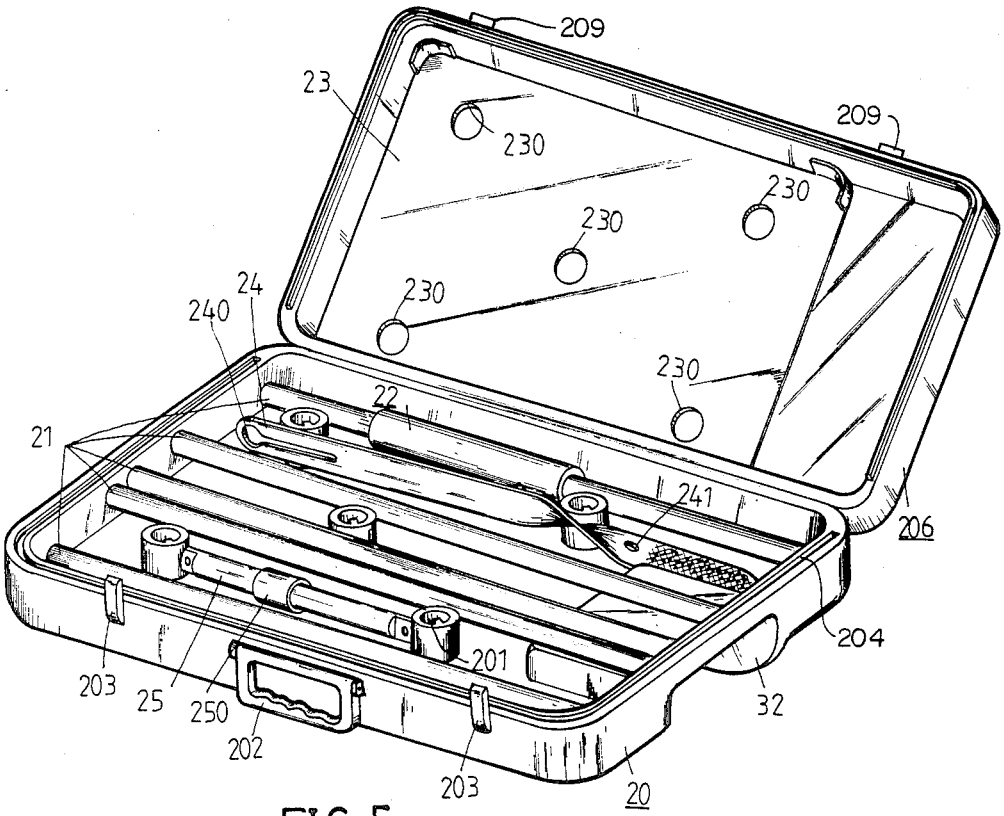
FIG. 5 is a perspective view showing the components of this invention dissembled and stored in a container.
Figure 6:
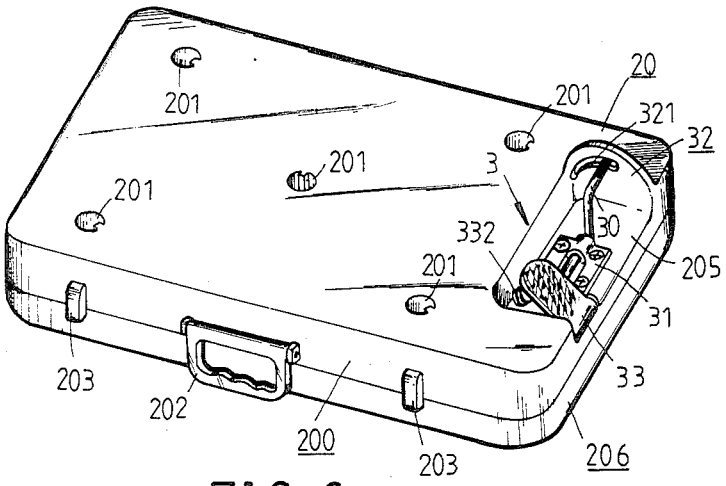
FIG. 6 is a perspective view showing the portable case of this invention.

FIGS. 5 and 6 show the opened and closed condition of the device of this invention as well as the shape under which it has been turned into a portable case after closing. When it is to be stored, all the elements for assembly are closed in between the upper and lower shells 200 and 206 are closed up in such a way that they will become a portable case as shown in FIG. 6 so as to facilitate the storage and transportion of the device.

We claim:

1. A method for packing articles into a case or container having a plurality of holes in a bottom wall comprising the steps of:

(a) providing a stationary base having a plurality of rods extending upwardly therefrom, the rods having first ends inserted into the base and second ends;

(b) providing a slide plate having a plurality of holes to allow passage of the plurality of rods;

(c) providing means to raise and lower the slide plate;

(d) placing a empty case on the slide plate;

(e) lowering the slide plate and case such that the second ends of the plurality of rods extend through the holes in the bottom wall of the case;

(f) supporting the articles to be packed on the second ends of the plurality of rods; and, (g) raising the slide plate and the case until the case surrounds the articles.

2. The method according to claim 1 wherein the step of providing means to raise and lower the slide plate comprises the steps of:

(a) placing a guide sleeve on one of the plurality of rods such that it bears against the slide plate;

(b) pivotally supporting a stopper arm between a pair of the rods; and, (c) attaching a first end of the stopper arm to the guide sleeve such that pivoting movement of the stopper ar raises or lowers the slide plate.

3. The method according to claim 2 comprising the additional steps of:

(a) forming a hook on a second end of the stopper arm; and, (b) providing a releasable latching mechanism on the base adapted to releasably engage the hook.

4. Apparatus for packing articles into or unpacking articles from a case or carton wherein the case or carton has a plurality of holes in a bottom wall, comprising:

(a) slide plate means for supporting the case or carton, the slide plate defining a plurality of holes in alignment with the holes in the bottom wall of the case;

(b) stationary base means;

(c) a plurality of rods having first ends mounted on the base means and second ends adapted to stationarily support articles thereon, the rods extending upwardly from the base means through the holes in the slide plate means and the case; and, (d) actuating means to raise the slide plate means and the case supported thereon to facilitate packing of the articles into the case and to lower the slide plate means and the case supported thereon to facilitate unpacking of the articles from the case.

5. The apparatus according to claim 4 wherein the actuating means comprises:

(a) a guide sleeve slidably mounted on one of the rods so as to contact the slide plate;

(b) a stopper arm having first and second ends;
(c) means to pivotally support the stopper arm between the first and second ends; and,
(d) attachment means to attach the first end of the stopper arm to the guide sleeve such that movement of the stopper arm about its pivot support raises and lowers the slide plate.

6. The apparatus according to claim 5 wherein the attachment means comprises:
(a) a slot defined by the stopper arm; and,
(b) protrusion extending from the guide sleeve and through the slot.

7. The apparatus according to claim 6 wherein the base means comprises:
(a) an upper shell defining a first plurality of holes to accommodate insertion of the first ends of the rods;
(b) a lower shell defining a second plurality of holes in alignment with the first plurality of holes to accommodate insertion of the first ends of the rods; and,
(c) hinge means attaching the upper and lower shells together.

8. The apparatus according to claim 7 wherein the upper and lower shells define a housing having a hollow interior to enclose the plurality of rods, the slide plate, the guide sleeve, the stopper arm and the cross-member when these elements are disassembled.

9. The apparatus according to claim 8 wherein the upper shell defines an indentation and further comprising:
(a) a generally "U" shaped rod having a center portion and leg portions extending from the center portion;
(b) means to pivotally attach the center portion of the "U" shaped rod to the upper shell in the indentation;
(c) foot pedal means pivotally attached to the upper shell in the indentation and engaging one of the side portions of the "U" shaped rod; and,
(d) hook means formed on the second end of the stopper arm adapted to engage an opposite side portion of the "U" shaped rod.

10. The apparatus according to claim 9 further comprising:
(a) handle means attached to the upper shell; and,
(b) latch means on the upper and lower shells adapted to fasten the shells together.

11. The apparatus according to claim 5 wherein the means to pivotally support the stopper arm comprises:
(a) a cross-member;
(b) means to fasten the cross-member between a pair of rods;
(c) a mounting tube supported on the cross-member;
(d) a pivot pin extending from the mounting tube; and
(e) a hole defined by the stopper arm to accommodate the pivot pin.

12. A method for unpacking articles from a case or carton having a plurality of holes in a bottom wall comprising the steps of:
(a) providing a stationary base having a plurality of rods extending upwardly therefrom, the rods having first end inserted into the base and second ends;
(b) providing a slide plate having a plurality of holes to allow passage of the plurality of rods;
(c) providing means to raise and lower the slide plate relative to the base;
(d) placing a case containing articles on the slide plate such that the holes in the bottom wall are in alignment with the plurality of rods; and,
(e) lowering the slide plate and the case such that the articles are stationarily supported on the second ends of the rods.

13. The method according to claim 12 comprising the additional steps of;
(a) placing a guide a sleeve on one of the plurality of rods such that it bears against the slide plate;
(b) pivotally supporting a stopper arm between a pair of the rods; and,
(c) attaching a first end of the stopper arm to the guide sleeve such that pivoting movement of the stopper arm lowers the slide plate.

14. The method according to claim 13 comprising the additional steps of:
(a) forming a hook on a second end of the stopper arm; and,
(b) providing a releasable latching mechanism on the base adapted to releasably engage the hook.

* * * * *